33-233 SR
8/27/85 OR 4,536,965

United States Patent [19]
Tildeblad

[11] Patent Number: 4,536,965
[45] Date of Patent: Aug. 27, 1985

[54] OPTICAL AIMING DEVICE

[76] Inventor: Bernhard Tildeblad, Grönsaksvägen 64, 611 45 Nyköping, Sweden

[21] Appl. No.: 548,322

[22] Filed: Nov. 3, 1983

[30] Foreign Application Priority Data

Nov. 3, 1982 [SE] Sweden ..... 8206249

[51] Int. Cl.[3] ..... F41G 1/14
[52] U.S. Cl. ..... 33/233
[58] Field of Search ..... 356/252, 253, 251, 247, 356/19–22; 33/246, 266, 233, 261, 241, 286, 242, 243, 265, 245, 227, 276; 42/1 S, 1 ST

[56] References Cited

U.S. PATENT DOCUMENTS 3,451,137 6/1969 Hart ..... 42/1 S
3,641,676 2/1972 Knutsen ..... 33/241

*Primary Examiner*—Harry N. Haroian
*Attorney, Agent, or Firm*—Cushman, Darby & Cushman

[57] ABSTRACT

An optical aiming device with a front sight and a rear sight. The front sight is in the form of an upstanding needle-like element or an illuminated fine spot. To prevent repeated accommodation movements of the lens of the eye during aiming of the weapon the rear sight comprises two prisms disposed at each side of the front sight. Each prism will produce an image of the front sight, said image lying at the same distance from the shot's eye as is the eye-front sight-distance.

7 Claims, 7 Drawing Figures

OPTICAL AIMING DEVICE

The present invention relates to an optical aiming device. As an aiming device there is used according to the invention, on the one hand, a front or post sight, and, on the other hand, two images of the front sight positioned symmetrically on either side of the front site in level therewith.

The Swedish patent specification No. 46 836 describes a front sight provided with a sharply marked vertical line, surface or the like. On the front sight prisms or lenses are provided. Light beams from the line or surface are totally reflected by the surfaces of the prism and are emitted from the said optical units in parallel to the plane of symmetry through the front sight and the rear sight. With the aid of this known front sight an improved lateral alignment of the weapon is obtained while at the same time the alignment is more quickly performed than with conventional open aiming devices of the type comprising a post sight and sight in the shape of a notch, ring or the like with which the post is aligned.

The disadvantage of the above-mentioned, known aiming device as well as with conventional open aiming devices result in the fact that the shooting person must focus the lens on the eye alternately between the target, the front sight and the rear sight when these units are to be mutually aligned. If the eye is focused on the target, the front and rear sights are blurred, if the eye is focused on the post of the front sight the target and rear sight are blurred and if the eye is focused on the rear sight, the target and front sight post are blurred. This problem is additionally pronounced when shooting is performed in darkness. Another draw-back experienced in connection with the known aiming devices of the type described resides in the fact that a certain limited time is required to enable the lens of the eye to change from a state of focusing on e.g. the rear sight to become focused on e.g. the front sight. As the lens of the eye must change its adaptation several times during the alignment of the weapon on the target, sighting requires long time.

The object of the present invention is to provide an aiming device eliminating the draw-backs mentioned above, experienced in connection with the known aiming devices described above.

The aiming device according to the invention comprises a front sight shaped as a vertical, needle-like element or an illuminated spot and a rear sight comprising two prisms disposed symmetrically on either side of the plane of symmetry through the front and rear sights. The front sight is in a conventional way disposed at a distance ahead of the rear sight. The prisms of the sight are so disposed so as to produce an image of the front sight each, said image being in level with the front sight, i.e. positioned in a vertical plane passing through the front sight and extending perpendicularly to the said plane of symmetry.

Due to the fact that the front sight and the images of this sight produced in the rear sight are positioned in level with the front sight no adaptation of the lens of the eye is required in order to mutually align the front and rear sights.. Thanks to this the adjustment of the arm becomes more exact and the aligning time shorter in comparison with the use of a conventional open sight.

Every prism of the sight comprises a first surface turned towards the front sight, a second surface turned towards the aiming person and a third surface turn towards the vertical plane of symmetry through the front and rear sights.

The angle formed by the first surface with the second surface may but need not be equal to the angle formed by the third surface with the second surface.

The second surfaces of the two prisms are thus turned towards each other and depending on the choice of the said angles and the actual distance between the front and rear sights these second surfaces may either be parallel to the vertical plane of symmetry through the front and rear sights or be at an angle with this plane. The minimum distance between the second, opposed surfaces must of course be greater than the maximum lateral extension of the front sight since, if not the front sight will not be visible between the opposide side surfaces of the prisms. The minimum spacing between said second opposed surfaces should be less than the minimum size of the pupil to cause the image of the front sight to stand out clearly.

According to a further development of the invention the side of the prism facing the aiming person is shaped as a lens magnifying the prism's image of the front sight.

DETAILED DESCRIPTION

Figure 1:
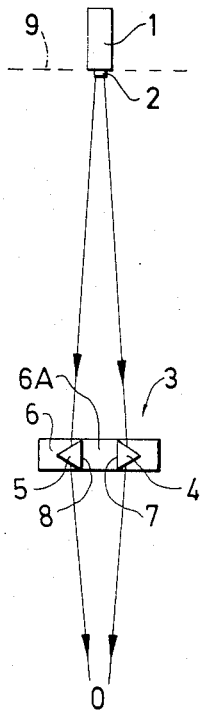
FIG. 1 is a plan view of an aiming device in accordance with the invention.

In FIG. 1 there is shown a forward sight comprising a light emitting diode (LED) 2 which is shielded to form an illuminated spot. From e.g. U.S. Pat. No. 3,698,092 it is known how such an illuminated spot is formed and, accordingly, this is not a part of the present invention.

Figure 4:
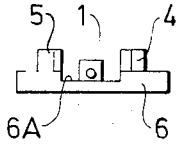

At a distance behind the front sight the rear sight 3 according to the present invention is provided. The rear sight comprises two prisms, 4, 5 respectively disposed symmetrically on either side of the plane of symmetry passing through the rear and front sights. Each prism 4, 5 comprises a first side facing the front sight, a second sight facing said plane of symmetry and a third side facing the aiming person the eye of which is schematically indicated by 0 in FIG. 1. Either prism is placed on its end surface and is attached to a base 6 having a recessed portion 6A (FIG. 4). Between the two opposed surfaces 7, and 8 respectively of prisms 4, 5 the aiming person sees the front sight post 1 and its illuminated surface 2. The prisms are disposed as described before in such a way that the aiming person viewing the front sight 1 between the prisms 4 and 5 also sees an image of the front sight in each of the prisms. The image of the front sight in either prism is in level with the front sight, i.e. is positioned in the plane 9 in FIG. 1 which extends perpendicularly to the plane of the drawing. Thus the eye of the aiming person needs not to be focused on the two prisms of the rear sight but only onto the front sight.

Figure 2:
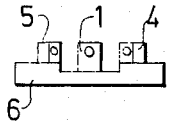
FIGS. 2, 3 and 4 are end views of the aiming device of FIG. 1 seen under different viewing angles.
Figure 3:
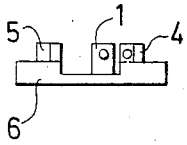

FIGS. 2, 3 and 4 show the image of the aiming device as seen by the aiming person during various states of alignment of the aiming device towards the target, not shown. In FIG. 2 the aiming device is correctly aligned both in elevation and laterally. The image of the front sight produced by the rear sight in this case is positioned at the same elevation as the front sight and symmetrically on either side of the front sight. FIG. 3 shows the aiming device correctly aligned in elevation but with faulty lateral aiming because it points slightly to the right of the target. The faulty alignment is so important that the image of the front sight produced by the left prism 5 has completely disappeared from the prism. The aiming person now knows that he is aiming too far to the right and, accordingly, moves the weapon more to the left causing the image of the front sight to appear in the left prism. The aiming person moves the weapon further to the left until the front sight is situated symmetrically between the two images of the front sights produced by the rear sight. In FIG. 4 the lateral alignment is correct whereas the vertical alignment is faulty. The aiming direction is too low, so low in this case that the images of the front sight produced by the rear sight completely disappear from the prisms. The aiming person correct this faulty alignment by slowly moving the weapon upwardly until the two images of the front sight become visible in the prisms and he continus to perform the upward correcting movement until the two images are on the same level as the front sight.

Figure 5:
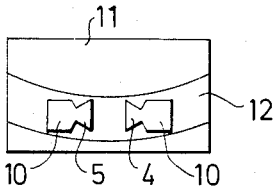
FIG. 5 is a horizontal projection of the aiming device of the present invention.
Figure 6:
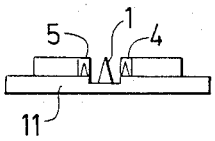
FIG. 6 is a vertical projection of one embodiment of an aiming device according to the invention.
Figure 7:
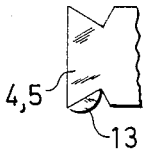
FIG. 7 shows a prism in which the surface facing the aiming person is provided with a curved surface.

FIGS. 5 and 6 show a practical embodiment of an aiming device according to the invention in which the front sight is a needle-like element and either prism, in addition to the said first, second and third surfaces, is also provided with a holder 10, shaped integrally with the prism in question. The prisms are manufactured from a rod of synthetic glass, Plexiglas, of rectangular cross section. A longitudinal triangular groove has been cut into the one surface of the rod and into the opposed end surface of the rod a second longitudinal groove having triangular cross section has been cut. Subsequently, the rod has been polished and cut into a number of prisms having the shape shown in the figures. The outer dimensions of the rod were 10×5 mm and the prisms were cut to a height of 2 mm. The angle between the second surface and the first surface, i.e. the surface facing the front sight, amounted to 60°, whereas the angle between the second surface and the surface facing the aiming person amounted to 80°. Either prism was thereafter placed onto a base plate 6 into which a groove 12 had been cut having a rectangular cross section and receiving the prism and its holder 10 with some play. The groove 12 is circular having a radius equal to the distance between the front and rear sights. Each prism was shifted along groove 12 until the image of the front sight appeared in the prism and in this position the prism was firmly attached by means of glue applied between the end surface of the prism and the bottom of the groove. FIG. 5 shows the image seen by the eye of the aiming person when the weapon is correctly aligned both in elevation and laterally. Finally, FIG. 7 shows that the third side of either prism facing the aiming person is provided with a curved, lens-shaped surface 13 magnifying the image of the front sight.

When the aiming distance (the distance between front and rear sights) amounts to about 1 meter the inventor has found that the angle between the first and second surfaces of the prism should amount to about 60°, whereas the angle between the second surface and the third surface should be about 80°. Then, the opposed surfaces of both prisms are nearly in parallel to each other and the spacing between them is about 5 mm. When the aiming distance is about 15 cm the said two angles are equally large and amount to about 60°. Also in this case the opposed surfaces of the prisms are almost in parallel to each other and the spacing between these opposed surfaces amounts in this case to about 3–4 mm.

The embodiments of the invention described above can be modified and varied in many ways within the frame of the inventive idea.

I claim:

1. Optical aiming device comprising a front sight and spaced therefrom a rear sight, said front sight comprising an upstanding needle-like element or an illuminated spot, characterized in that the rear sight comprises two prisms disposed symmetrically on either side of the plane of symmetry through the front and rear sights and disposed so as to produce one image each of the front sight, said image lying in level with the front sight.

2. Optical aiming device as claimed in claim 1, characterized in that either prism comprises a first surface facing the front sight, a second surface facing the plane of symmetry through the front and rear sights and a third surface facing the aiming person, the spacing between said second surfaces being greater than at least the lateral extension of the front sight.

3. Optical aiming device as claimed in claim 2, characterized in that the minimum spacing between the opposed side surfaces is less than the least pupil size.

4. Optical aiming device as claimed in claim 3, characterized in that the prisms are attached to a support plate.

5. Optical aiming device as claimed in claim 2, characterized in that the second and third side surfaces of each prism meet in a widened portion, extending crosswise in relation to the second side surface and being integral with the prism and extending away from said opposed side surface to serve as a holder of the prism.

6. Optical aiming device as claimed in claim 5, characterized in that base plate is provided with a groove for receiving the two prisms, said groove extending along an imaginary arc of a circle in which the front sight forms the centre.

7. Optical aiming device as claimed in claim 1, characterized in that the third surface on either prism is curved to produce a magnified image of the front sight.

* * * * *